US005175018A

United States Patent [19]

Lee et al.

[11] Patent Number: 5,175,018

[45] Date of Patent: Dec. 29, 1992

[54] AUTOMATED MASKING DEVICE FOR ROBOTIC PAINTING/COATING

[75] Inventors: Jay Lee, Gaithersburg, Md.; Alex Mauro, Wheatley Heights, N.Y.

[73] Assignee: Robotic Vision Systems, Inc., Hauppauge, N.Y.

[21] Appl. No.: 714,316

[22] Filed: Jun. 10, 1991

Related U.S. Application Data

[63] Continuation of Ser. No. 643,544, Jan. 18, 1991, abandoned, which is a continuation-in-part of Ser. No. 330,599, Mar. 29, 1989, abandoned.

[51] Int. Cl.[5] ..... B05B 1/28; B05B 15/04

[52] U.S. Cl. ..... 427/8; 118/301; 118/323; 118/669; 118/679; 118/712; 427/421; 427/282; 901/43; 901/47

[58] Field of Search ..... 118/669, 679, 712, 713, 118/301, 323; 427/424, 8, 421, 282; 901/43, 47

[56] References Cited

U.S. PATENT DOCUMENTS

| | | | |
|---|---|---|---|
| 3,742,901 | 7/1973 | Johnston | 118/323 X |
| 4,144,837 | 3/1979 | Johnston | 118/323 X |
| 4,254,433 | 3/1981 | Dewar, Jr. et al. | 901/46 X |
| 4,527,507 | 7/1985 | Sawai et al. | 118/301 X |
| 4,941,182 | 7/1990 | Patel | 901/43 X |
| 4,974,532 | 12/1990 | March | 118/301 |
| 5,110,615 | 5/1992 | Maiorca et al. | 427/8 |

*Primary Examiner*—Michael G. Wityshyn
*Attorney, Agent, or Firm*—Max Fogiel

[57] ABSTRACT

Methods and arrangements for automation of the masking process for spray painting and other material spray deposition. The methods provide masking simultaneous with the material spray to thereby eliminate additional mask application and removal processes. The arrangements provide non-contact masking and unused material recovery. Air curtain masking and solid non-consumable masking methods are provided.

3 Claims, 12 Drawing Sheets

AUTOMATED MASKING DEVICE FOR ROBOTIC PAINTING/COATING

The present application is a continuation of the parent application Ser. No. 643,544 filed Jan. 18, 1991, now abandoned, which is a continuation-in-part of Ser. No. 330,599, filed Mar. 29, 1989, now abandoned.

BACKGROUND OF THE INVENTION

Vinyl lower body coating (stone chip) material is being used in the automotive industry. At the present time, this coating process is done by manual methods. It is time consuming and tedious work. In a typical lower body coating process, it takes seven minutes to put mask paper on the car body to prevent overspray. In order to reduce the cycle time and increase coating quality, an automated masking device was designed to integrate with industrial robots for improving current capability.

SUMMARY OF THE INVENTION

It is an object of the present invention to overcome the prior art disadvantages. In particular, it is the object of the present invention to provide a method and an arrangement for eliminating the need to attach masking material to prevent coating materials from crossing well-defined boundaries of application.

In keeping with this object and with still others which will become apparent as the description proceeds, an important characteristic of the invention is the elimination of manual masking. Masking, according to the present invention, is done at the same time as coating thereby avoiding additional manufacturing time as would ordinarily be required by an additional sequential step.

Recovery of unused material for resuse is also an object of the present invention.

The present invention consists of the steps of providing a shield attached to the robot end effector that carries the coating tool; placing the shield in a position between the coating spray nozzle and surface to be coated to prevent the coating of areas beyond a designated boundary: spraying the coating material on the surface to be coated; removing from the shield the unused material intercepted by the shield; and returning the reclaimed material to the source of coating material.

One embodiment of the invention employs an air shield which avoids the necessity for providing a means for reclaiming unused material. Another embodiment of the present invention employs a rotating belt for a shield with a wiper to reclaim the unused material. A further embodiment of the invention employs a rotating disc for a shield with a wiper to reclaim the unused material.

When using mechanical shields it is possible to obtain well defined boundaries without causing the shield to make contact with the surface to be coated. The method and arrangements disclosed herein make use of this concept.

The invention will hereafter be described with reference to an exemplary embodiment, as illustrated in the drawings. However, it is to be understood that this embodiment is illustrated and described for the purpose of information only, and that nothing therein is to be considered limiting of any aspect of the invention.

DESCRIPTION OF THE PREFERRED EMBODIMENT

Figure 1:
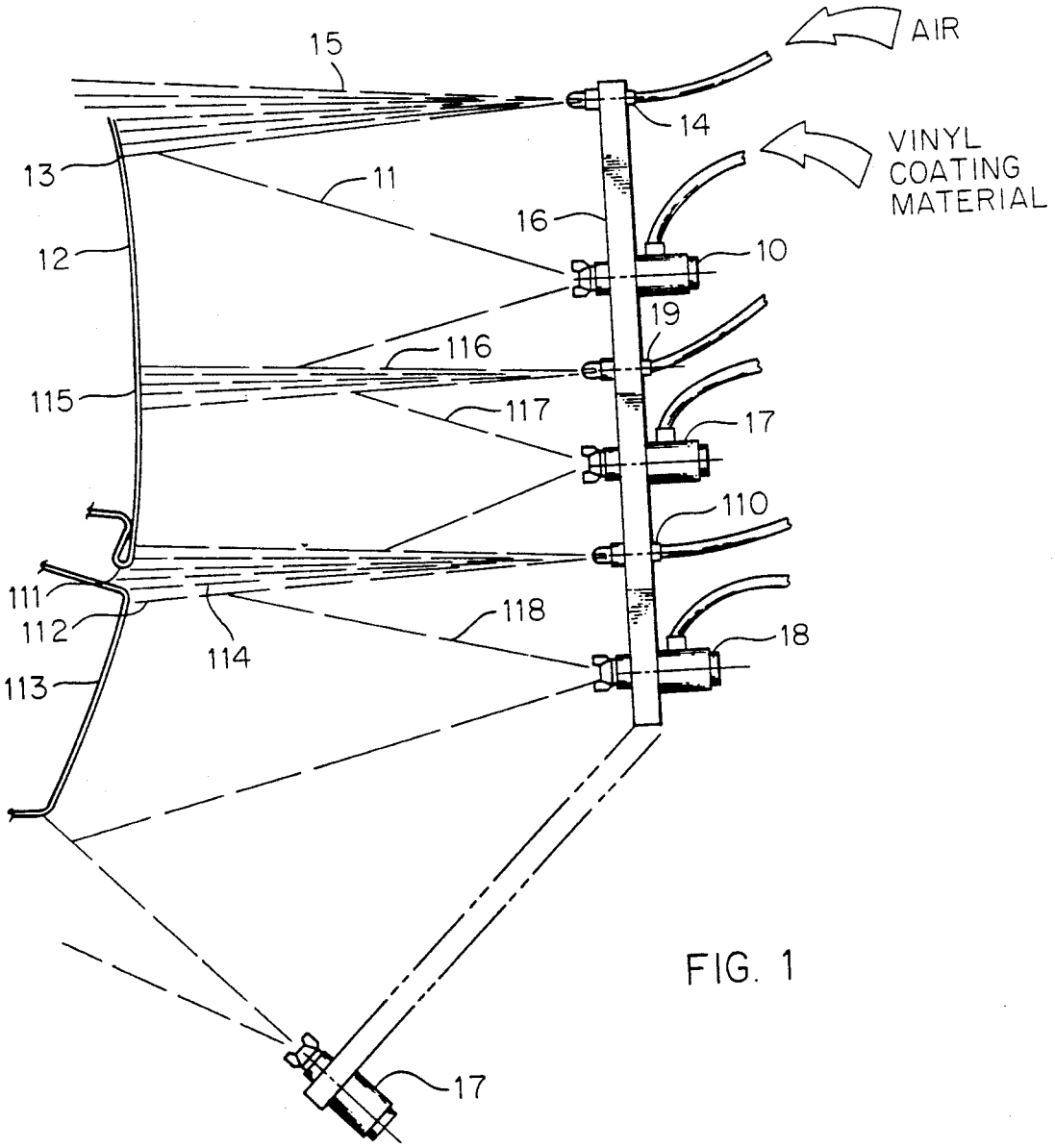
FIG. 1 shows schematically an air curtain used to mask surface areas from a coating spray.

FIG. 1 illustrates a method of preventing over-spray from a coating procedure. Spray nozzle 10 releases coating material under pressure as a spray 11 to coat an area on surface 12. It is desired to have the coating at a fairly uniform thickness up to boundary 13, and be completely absent beyond boundary 13. This can be accomplished by applying masking tape and paper along boundary 13. However, it is desirable to eliminate the time and cost required to accomplish this. This objective can be achieved by adding an air jet nozzle 14 to robot end effector 16 to form an air curtain mask 15 by air under pressure emitted by nozzle 14 aimed at preventing coating spray 11 from crossing boundary 13.

Other spray nozzles 17 and 18 may be added to end effector 16 to obtain more coverage simultaneously. Likewise, additional air jet nozzles 19, 110 may be added to end effector 16 to provide additional masking functions. For instance, a different material or color may be desired on surface 113 than on surface 12. One material 117 can be sprayed from nozzle 17 and another material 118 or color can be sprayed from nozzle 18 with air curtain mask 114 from nozzle 110 maintaining boundaries 111 and 112 to prevent overspray of either material into the other's area.

For localized areas to be masked, such as molding clip 115, air jet nozzle 19 can be provided with pressurized air while spray 11 and 117 pass the region of clip 115. Air paint deflector 116 will then keep the sprayed material from coating clip 115.

Figure 2:
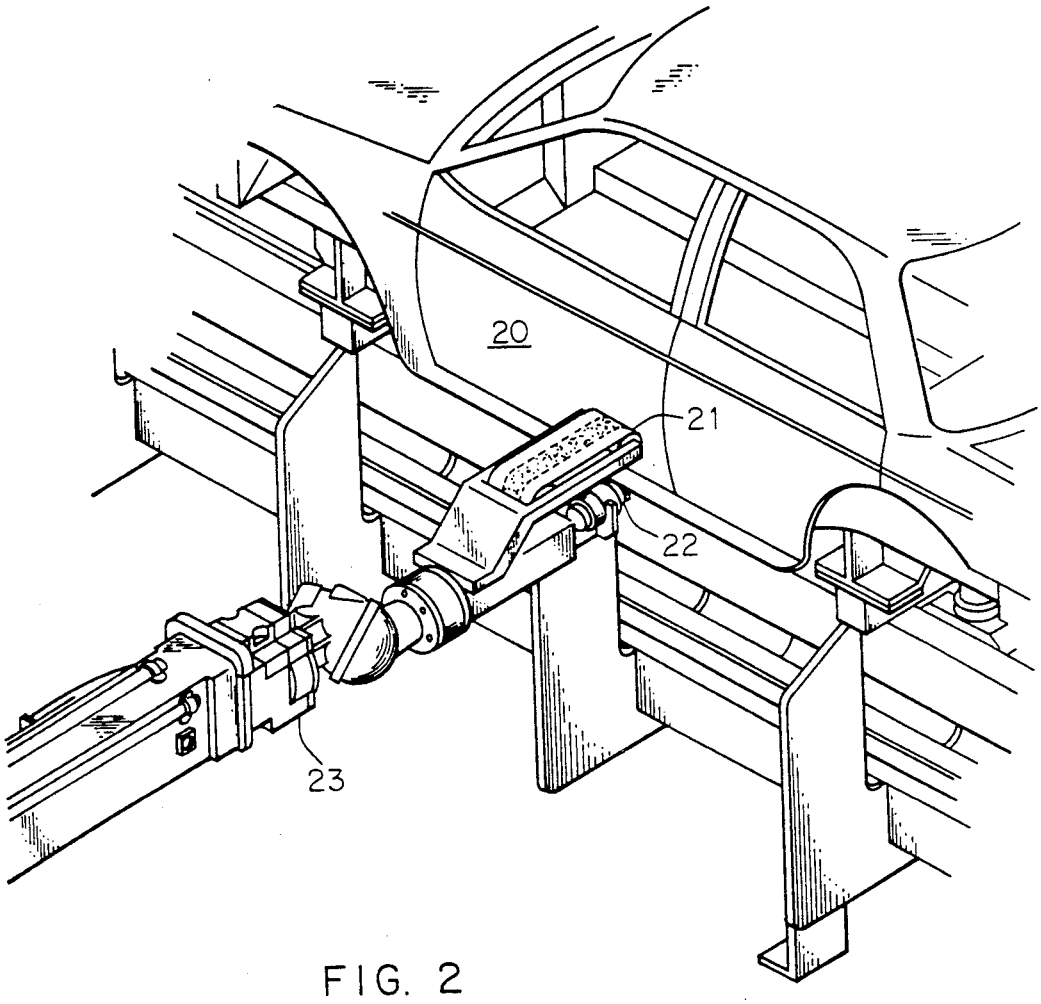
FIG. 2 is a partial perspective view and shows the use of a horizontal belt mask mounted on a robot arm.

Although using air jet masking is simple and economical, the edge definition may not be adequate for many applications. A better edge definition can be obtained by placing a solid barrier in the path of the unwanted portion of the material spray. FIG. 2 illustrates one implementation of this method. Horizontally mounted belt 21 continuously rotates, carrying away material that it intercepts from spray gun 22 as it sprays car 20. Belt 21 is placed close to car 20 to provide a well defined edge to the sprayed surface, but with sufficient clearance to not touch the surface as robot arm 23 transports the spray gun and belt along car 20.

Figure 3C:
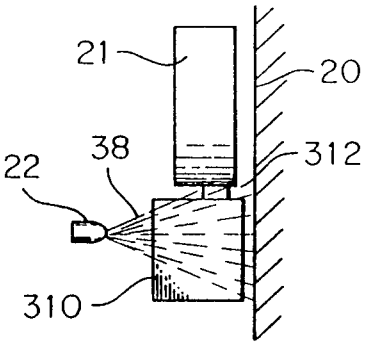
FIG. 3*c* is a side view of the vertically mounted belt mask.
Figure 3B:
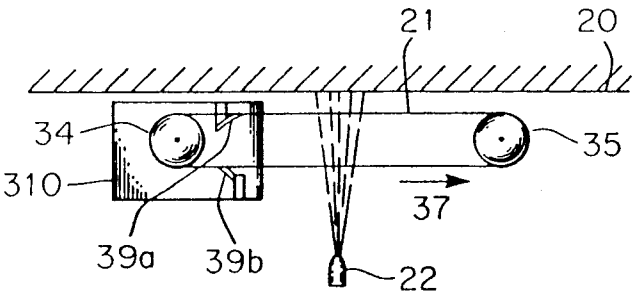
FIG. 3*b* is a top view of a vertically mounted belt mask.
Figure 3A:
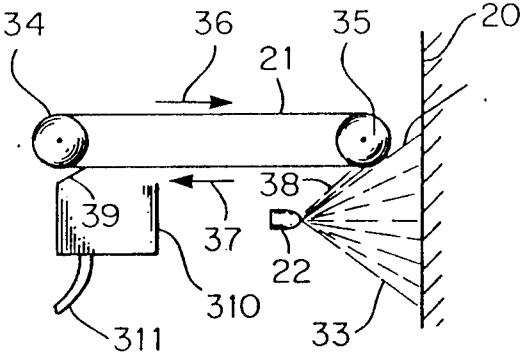
FIG. 3*a* is a side view of a horizontal belt mask with coating spray.

FIG. 3*a* provides greater detail on this method. In FIG. 3*a*, a side view of a horizontally mounted belt masking system is shown. Spray nozzle 22 emits material to coat surface 20. Spray edge 38 is not sufficiently well defined to provide a desired boundary to the coated area. By adding a rotating belt 21 physically attached to nozzle 22 such that it intercepts a portion of the edge of the spray, a well defined spray edge 312 is formed. The opposite edge 33 is left unconstrained.

Rollers 34 and 35 transport belt 21 in the direction indicated by arrows 36 and 37 or in the opposite direction, if preferable. The sprayed coating that is intercepted by belt 21 adheres to belt 21, and is transported to a wiper 39 that scrapes the coating from belt 21. The material scraped from belt 21 is collected in container 310 and drawn off for re-use via return line 311.

Alternately, the belt may be mounted on its side parallel to the surface to be coated. FIG. 3*b* shows this method in plan view as viewed from above to again provide a horizontally masked coating boundary. Both methods could be applied to vertical boundaries as well. FIG. 3*c* provides a side view of the vertically mounted belt. The numbering for similar functioning parts is the same as in FIG. 3*a*.

Again, surface 20 is to be coated by spraying material from nozzle 22 and a well defined boundary to the coating on surface 20 is desired. A rotating belt 21 is attached to spray nozzle 22 so that they will be transported together and provide the desired boundary. Rotating rollers 34, 35 provide the means for transporting belt 21 in the direction indicated by arrow 37. The purpose of moving the belt is to prevent material build-up as before. Now, however, it may be seen in FIG. 3*c* that the interior surface of belt 21 intercepts some of the sprayed coating. Therefore, two wipers 39*a*, 39*b* are supplied to scrape off any accumulated coating material on belt 21. An interior surface wiper 39*a* and an exterior surface wiper 39*b* scrape away any coating into collecting container 310. Again, the poorly defined spray edge 38 is intercepted by belt 21 leaving a well defined spray edge 312.

The advantage of using a rotating belt transverse to the direction of spray head motion, as in FIG. 3*a*, or parallel to the direction of spray head motion, as in FIGS. 3*b* and 3*c*, is that the masking surface is linear and provides an ideal masking contour for maintaining linear boundaries.

Figure 3D:
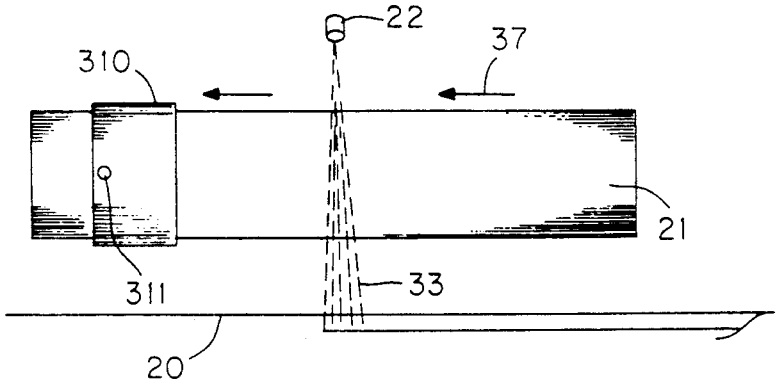
FIG. 3*d* is a bottom view of a masking belt mounted perpendicular to a surface.
Figure 3E:
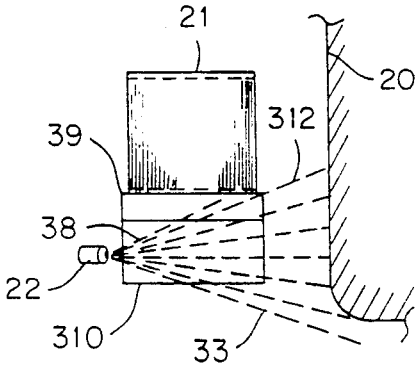
FIG. 3*e* is a side view of the masking belt mounted perpendicular to a surface.
Figure 3F:
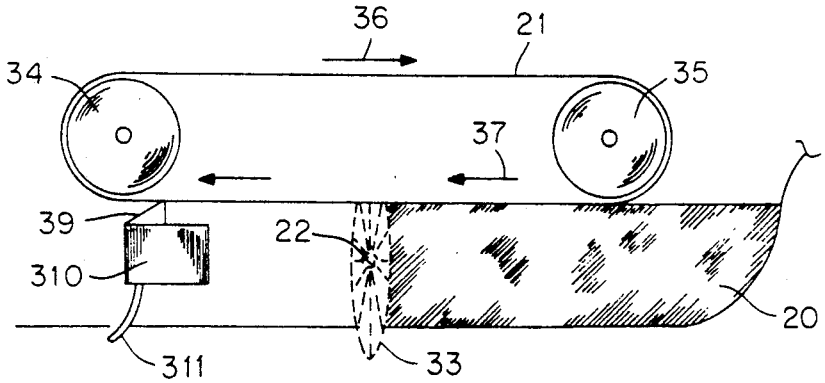
FIG. 3*f* is a front view of the masking belt mounted perpendicular to a surface.

FIG. 3*d* shows a bottom view of an alternate arrangement of a belt mask 21 running perpendicular to the surface to be coated. It has the advantage over the arrangement of FIG. 3*b* in that only one scraper 39 is required and the coating does not get on the interior side of the belt 21. In all other ways, the previous description applies. FIGS. 3*e* and 3*f* provide side and front views respectively.

Figure 4:
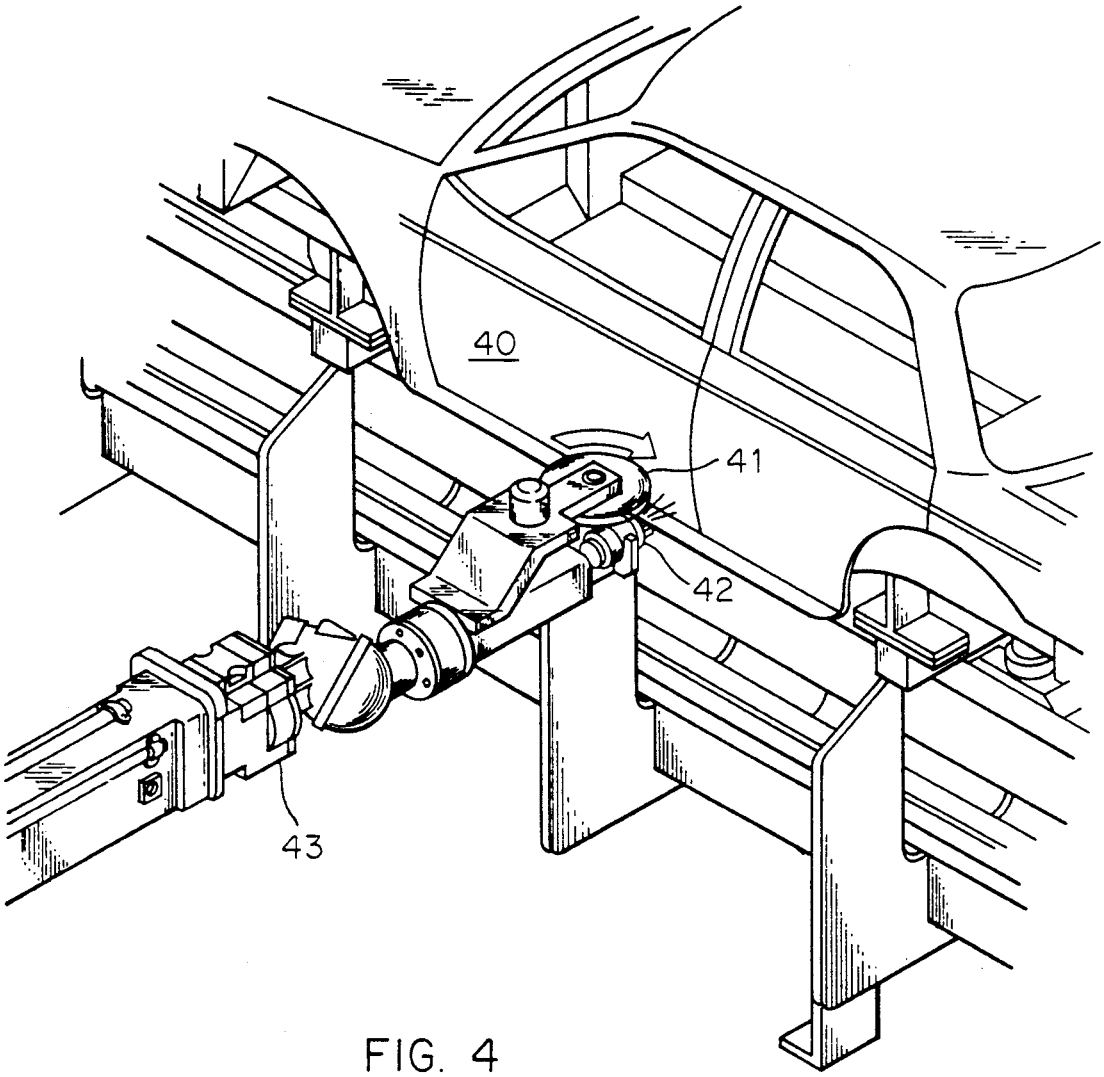
FIG. 4 is a partial perspective view and shows the use of a horizontal disc mask mounted on a robot arm.

FIG. 4 illustrates how a rotating disc can be used to obtain a linearly masked boundary even though the masking edge is curved. Since no flexing is involved, rigid materials can be used for the disc. As robot arm 43 transports spray head 42 horizontally along the side of car 40, rotating disc 41 masks the upper edge of the material spray to provide a well-defined coating boundary.

Figure 5:
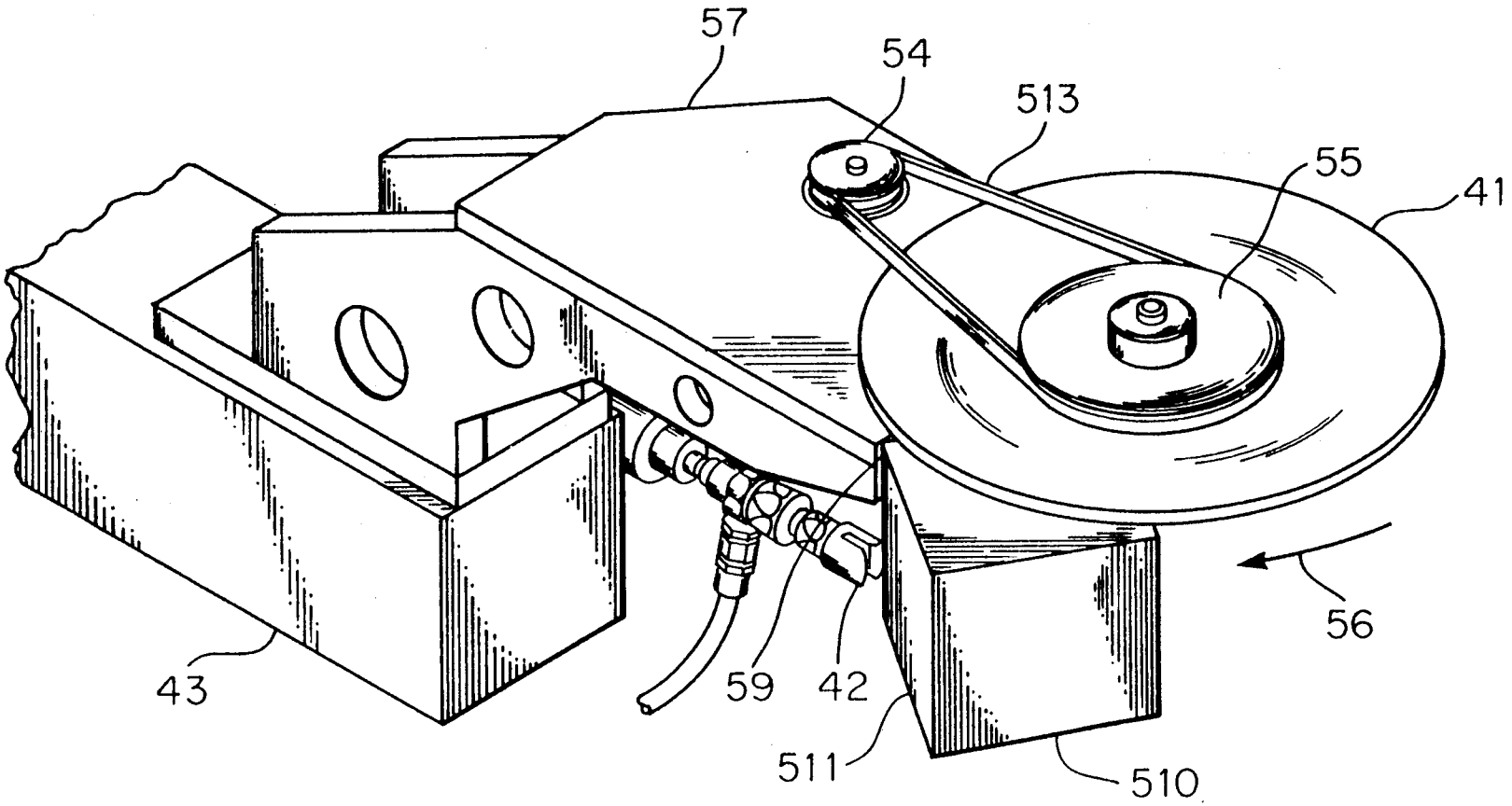
FIG. 5 is a perspective view and shows a horizontal disc mask in greater detail.

A more detailed view can be seen in FIG. 5. Support 57 is attached to robot arm 43 to hold masking disc 41 and material recovery container 510. Motor-driven pulley 54 rotates disc 41 via belt 513 and pulley 55, in direction 56. Material spray nozzle 42, attached to robot arm 43 emits a material spray with upper part of the spray pattern masked by disc 41. Material that accumulates on disc 41 as a result of this masking is rotated by disc 41 to scraper 59 which removes the accumulated material that falls by gravity into collection container 510 for recovery via return line 511.

Figure 6:
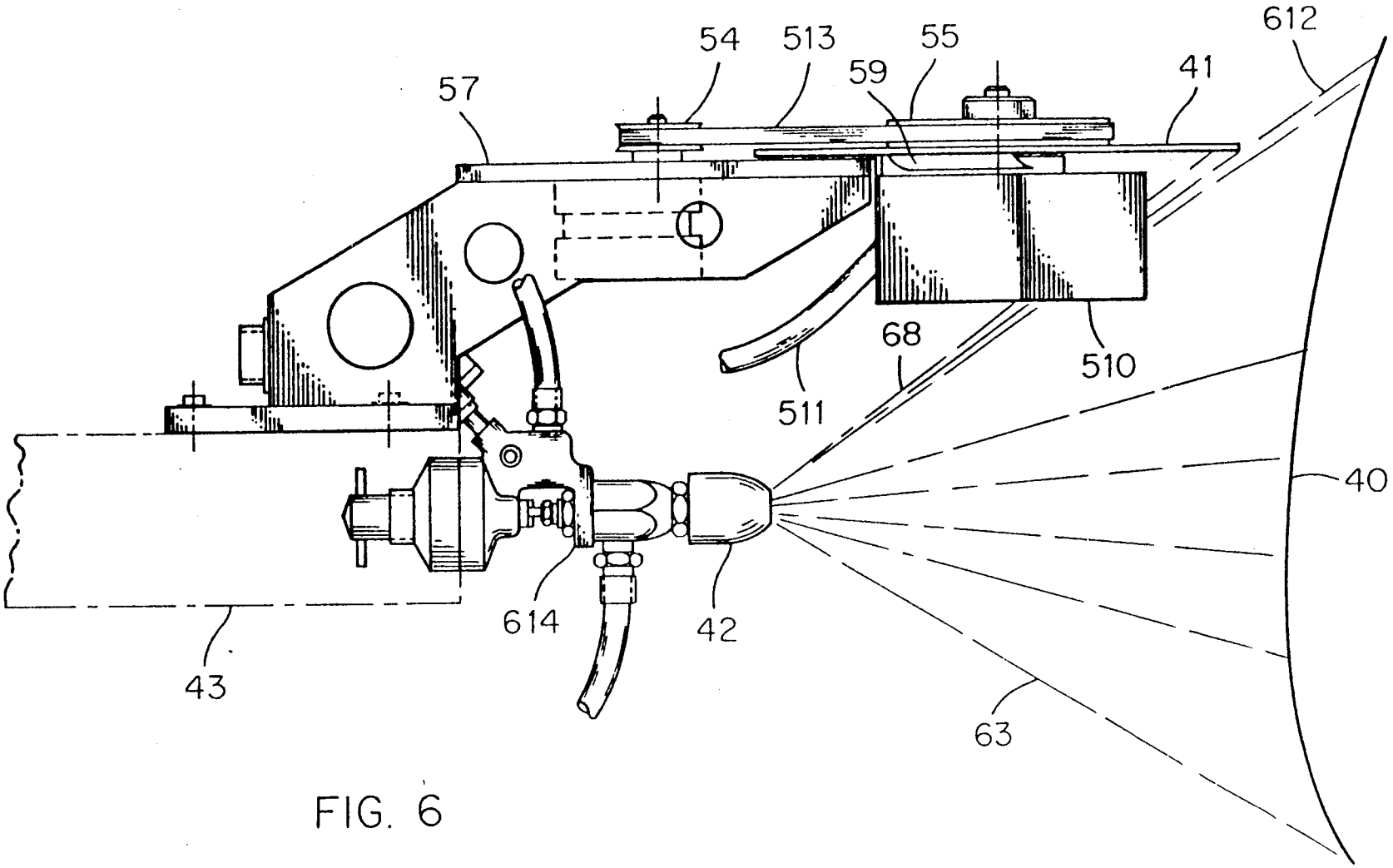
FIG. 6 is a side view of the horizontal disc mask.

FIG. 6 provides a side view illustrating the masking action of disc 41 on material paths 68 that deposit on disc 41 rather than on surface 40. Material path 612 which passes the edge of disc 41 thus provides a sharply-defined material deposition boundary without the need of a physically contacting masking material. Spray edge 63 which is unconfined provides a less defined boundary that is acceptable for its location. The spray is emitted by nozzle 42 on gun 614 mounted on robot arm 43 beneath disc support 57.

Figure 7:
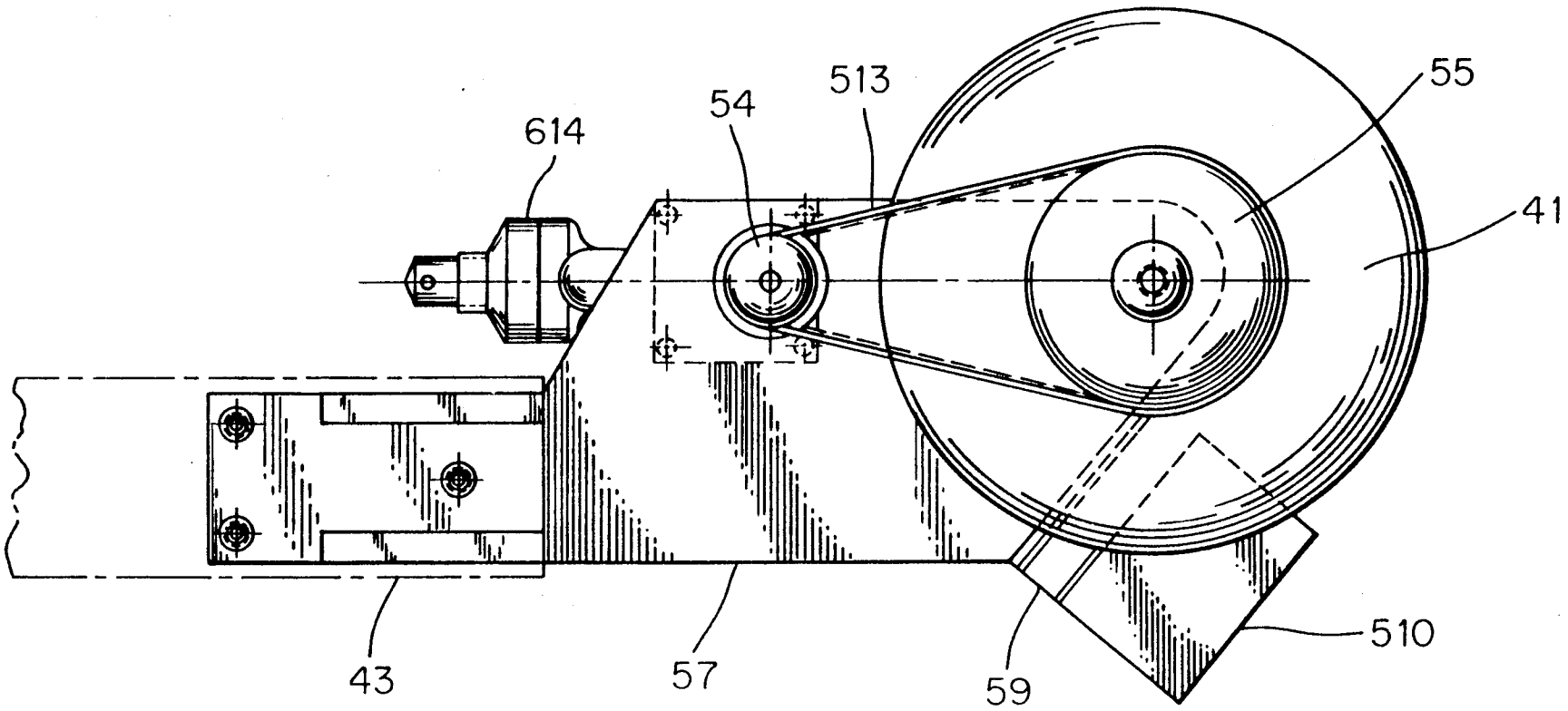
FIG. 7 is a top view of the horizontal disc mask.

FIG. 7 provides a plan view from above of how disc 41 is aligned along the central axis of gun 614.

Close positioning of solid barrier masking surfaces to the surface to be coated provides the best boundary definition. Therefore, this is a necessary consideration in the design. Other variables requiring control are spray beam width, spray velocity, and material viscosity.

The present invention has been described and illustrated with reference to an exemplary embodiment. It is not to be considered limited thereto, inasmuch as all modifications and variations which might offer themselves are intended to be encompassed within the scope of the appended claims.

Mask Device

The mask device as described in the preceding paragraphs has as its objective to produce a discrete separation between the sprayed and unsprayed surface. The separation or definition of the mask line is known to be a direct function of the distance between the surface and the outer edge of the mask. In applications where eye pleasing appearance is critical this distance must be maintained constant to present a uniform edge. This is not a great problem on flat or cylindrical surfaces but when considering curved and styled surfaces the maintenance of a constant gap between the surface and mask is a difficult problem. Likewise the production techniques which produce styled surfaces do not lend themselves to accurate location of the styled surfaces. These problems are overcome by providing a spray and mask system which can follow a totally flexible path. The flexible path is provided by mounting the entire mask and spray assembly on the end of a robotic manipulator. A machine vision system is employed to directly view the styling features to which the relationship of the mask line is critical. A taught robot path which maintains the uniform gap and the desired mask line is then transformed in space on each new object to position the mask line in the same location relative to the styling features detected by the vision system. The entire system allows the spray masking technology to be applied in applications where the mask line requires an adaptive path and complex motion.

Figure 8:
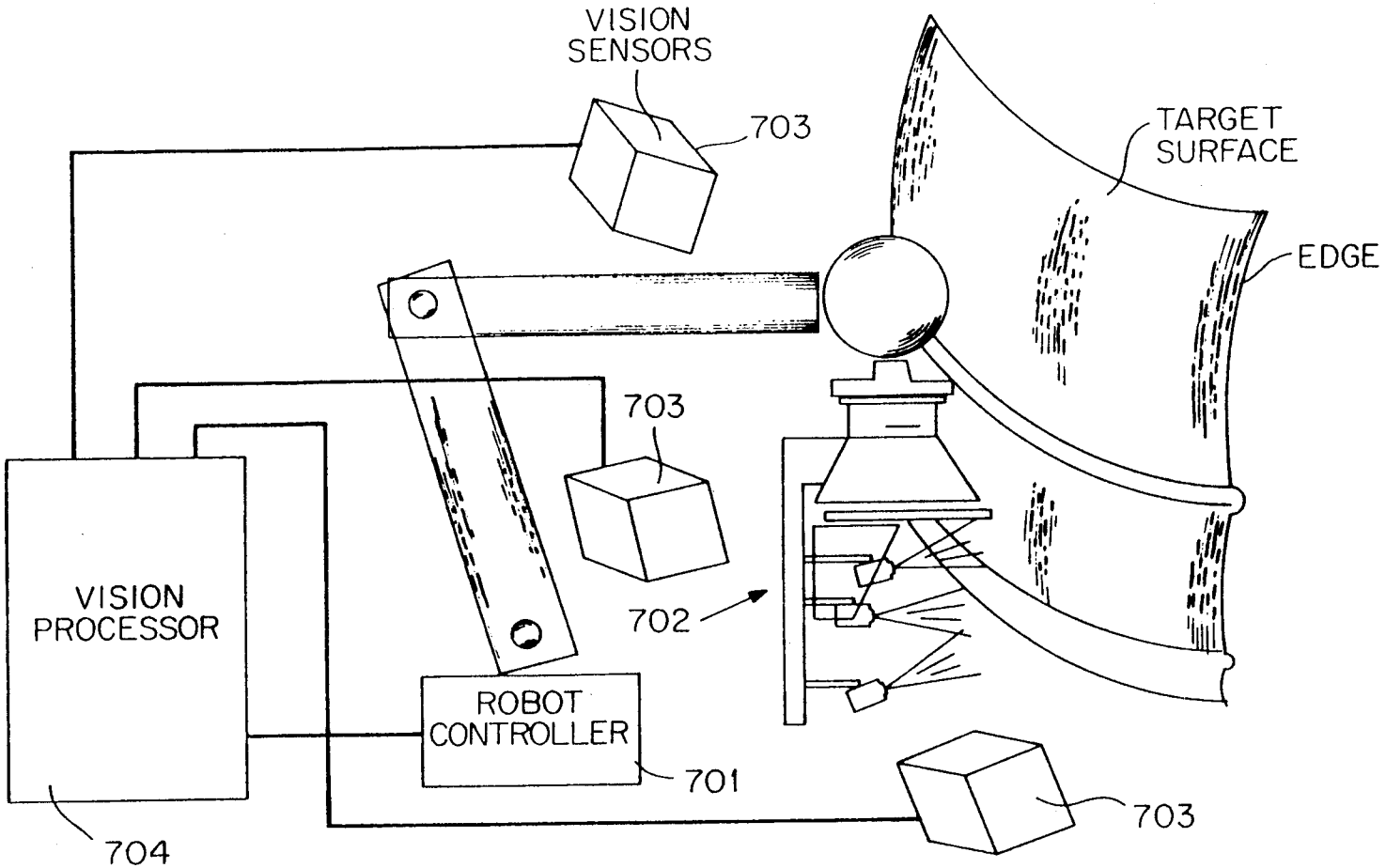
FIG. 8 is a schematic view and shows an embodiment applied to where the mask line requires an adaptive path and complex motion.
Figure 9:
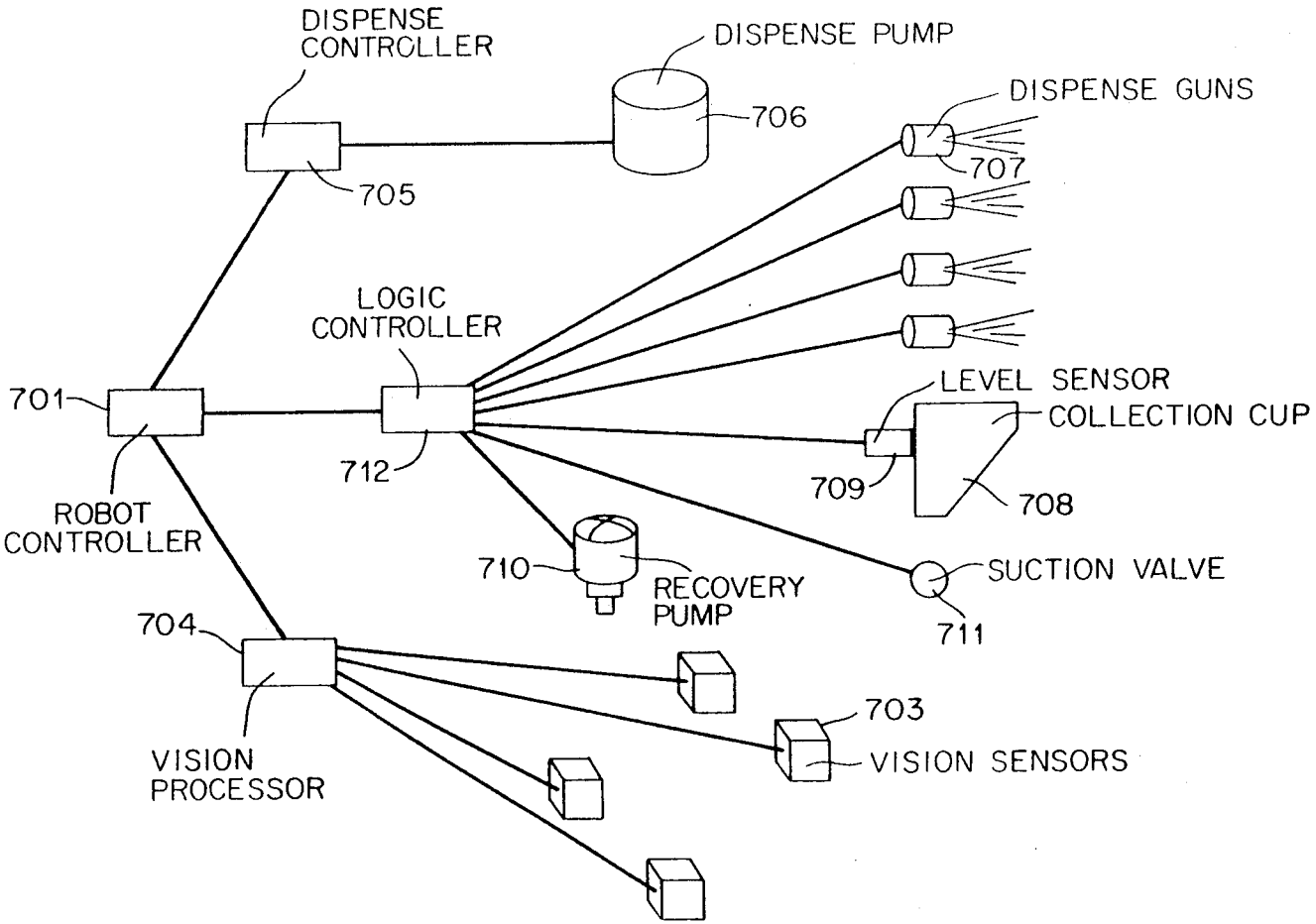
FIG. 9 is a block diagram to include additional system components, according to the present invention.

The preferred embodiment of this invention is shown in FIG. 8 and consists of an articulated arm robot (701) which transports the combination dispense and mask device (702) along a complex path so as to maintain a constant distance between the surface being sprayed and the outer edge of the mask. 3-D vision sensors (703) are used to return 3-D surface data to a vision processor (704). The vision processor extracts 3-D feature coordinates from each sensor and calculates the correct six degree of freedom transformation matrix to be applied to the nominal robot path to maintain the mask line position and the distance to the dispensing device constant regardless of where the surface is located with respect to the robot. The vision processor sends the transformation data over a serial communications port to the robot (701). A System Block Diagram is shown in FIG. 9 where the remainder of the system components are identified. Once the robot (701) has received a transform matrix from the vision processor (704) the dispense and mask device (702) is transported along its revised path and commands are sent to the dispense controller (705) to pressurize the dispense pump (706) and to the logic controller (712) for controlling the opening and closing of dispense guns (707).

Path Transformation

Figure 10:
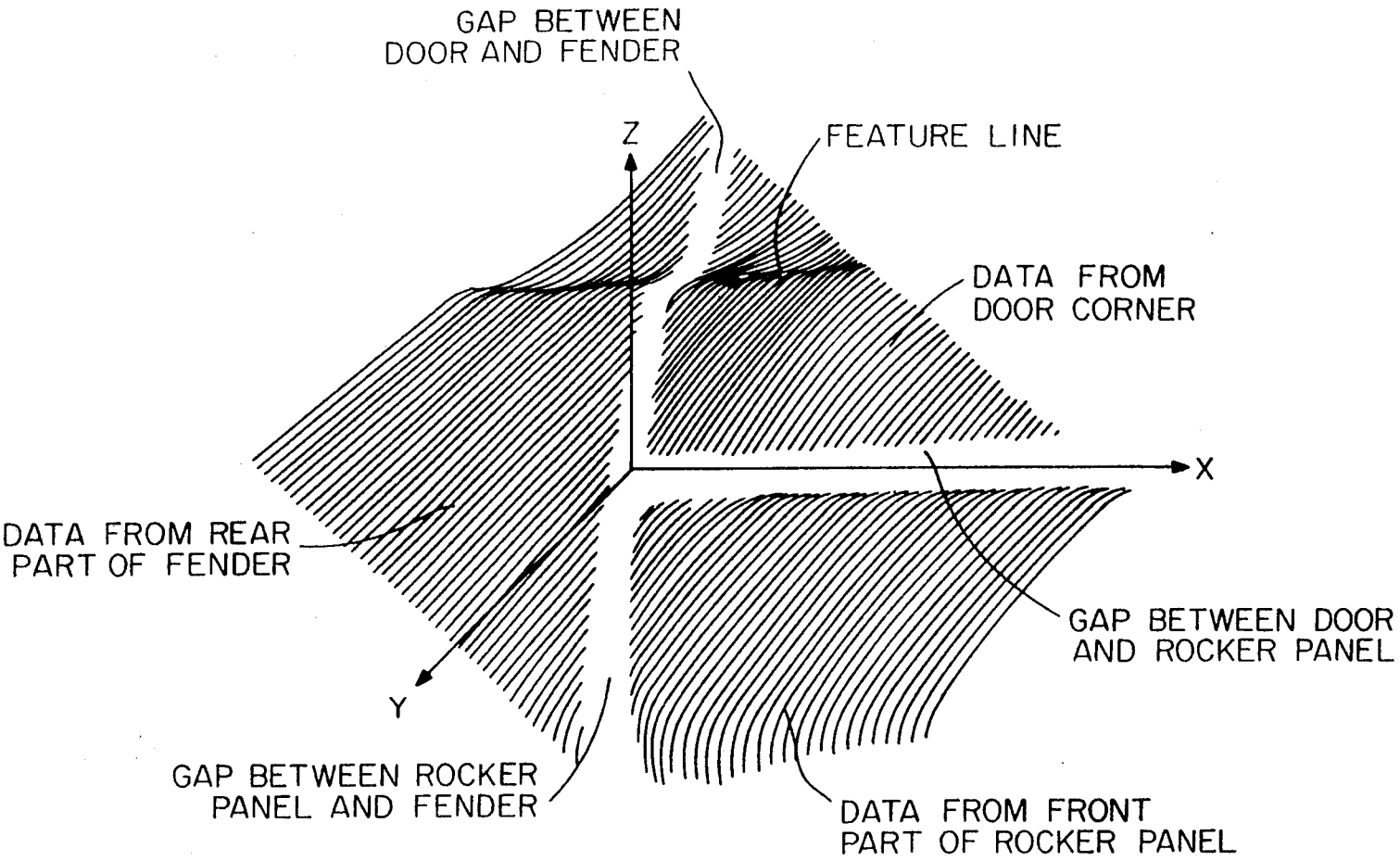
FIG. 10 is a graphical representation and shows 3-D data returned by an individual sensor.

The features used to locate the surface are preferably as close to the desired spray line as possible to avoid errors due to distortion of the surface. Software locates the surface features using the 3-D sensor data and extracts key feature coordinates. FIG. 10 shows a plot of 3-D data returned by an individual sensor (703) where the surface curvature and location of features can be seen. The coordinate system of the feature is calculated and used along with the location of other features to calculate the best robot path.

Systems which attempt to spray complex surfaces must also contend with warping and flexibility due to variations in the support structure. These factors are compensated for by combining the feature location data in a weighted least square estimate of the best transformation matrix. Usually features located very close to the spray line receive larger weights and features located at a further distance receive a lower weighting. This corresponds to the eyes ability to quickly establish a lack of correspondence between the spray line and the features closest to the spray line.

The block diagram of the system is shown in FIG. 9. Each system contains a multiplicity of 3-D vision sensors (703) which detect features on the surface to be sprayed. The 3-D data from each sensor is received by the vision processor (704) and the location of the feature is calculated. The feature locations are compared to nominal locations (those used during initial path teaching) on a weighted least square basis and a transformation matrix calculated. A unique transformation is computed for each robot path due to the difference of weighting of the coordinates of each feature point. Each feature point may have a separate coordinate value for each of x, y, and z. The resulting transformation matrix is communicated to the robots (701) over a serial interface cable (705). The robot will then follow a modified path to spray the complex contoured surface in response to actual feature locations.

It should be noted that each 3-D vision sensor may be replaced by two 2-D vision sensors (stereo pair) that can provide equivalent data, or by one 2-D vision sensor (camera) when only partial data is needed for a particular feature due to the multiplicity of other sensors.

Material Recovery

Figure 8A:
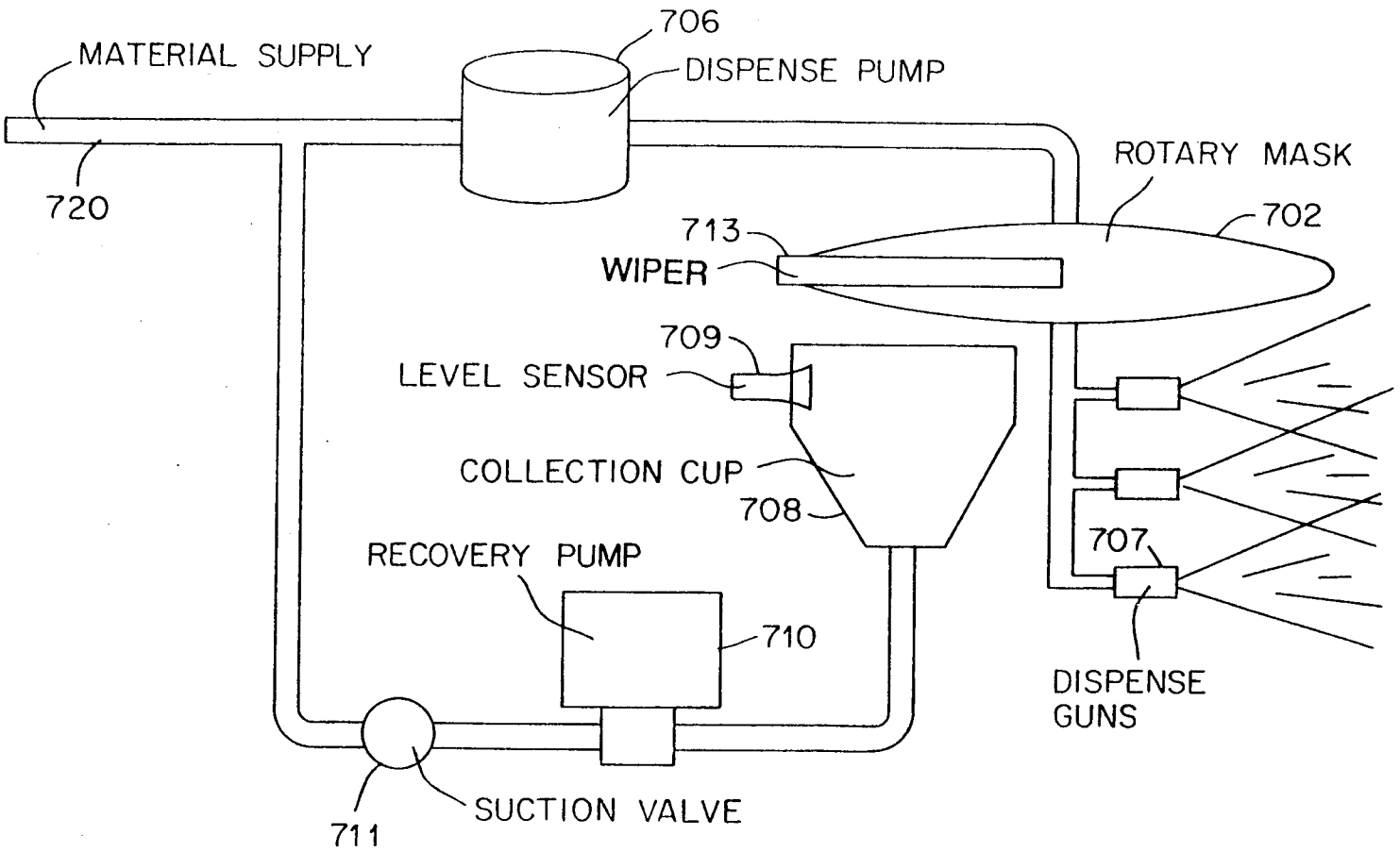
FIG. 8A is a schematic view of a recovery system as part of the overall mask device.

The application of a mask to the robot transport and adaptive path following requires special methods of handling material removed from the mask. FIG. 8*a* shows the detail of the recovery system which is part of the overall mask device (702). The rotary mask (702) is placed in the spray path to create a clean mask line on the surface. Material striking the mask (702) is transported by its rotation to a wiper (713) which removes it from the surface whence it is transported by gravity into a collection cup (708). A level sensor (709) detects the level of material in the collection cup and signals the logic controller (712) which in turn activates a recovery pump (710) and suction valve (711). The recovery pump removes material from the collection cup and introduces it under pressure back into the supply header (720). Once the recovery pump has run for a predetermined amount of time (removed a preset amount of material) the recovery pump shuts off and the suction valve closes. Immediately following a material removal cycle the level sensor will be inhibited from activating a new cycle to allow time for the material to flow to the bottom of the collection cup. The overall function is to provide a closed loop system not requiring frequent operator intervention for material removal or maintenance.

What is claimed is:

1. A method of producing a non-contact mask for sprayed material comprising the steps of: providing at least one material spray; providing at least one moving air curtain mask; aiming said air curtain mask to apply a desired boundary to said material spray; transporting said spray and mask along predetermined paths relative to surfaces upon which material deposition of said sprayed material is to be applied with well defined boundaries; placing two-dimensional or three-dimensional machine vision sensors at multiple sites; maneuvering said moving mask by a robot using information from said vision sensors to maneuver the robot for establishing a desired mask line and to maintain an optimum distance between mask line and the mask.

2. A method of producing a non-contact mask for sprayed material comprising the steps of: providing at least one material spray; providing at least one moving rotary mask; aiming said material spray at a predetermined substantially oblique angle to said rotary mask to apply a desired boundary to said material spray; transporting said spray and mask along predetermined paths relative to surfaces upon which material deposition of said sprayed material is to be applied with well defined boundaries; placing two-dimensional or three-dimensional machine vision sensors at multiple sites; maneuvering said moving mask by a robot using information from said vision sensors to maneuver the robot for establishing a desired mask line and to maintain an optimum distance between mask line and the mask.

3. A method of producing a non-contact mask for sprayed material comprising the steps of: providing at least one material spray; providing at least one moving belt mask; aiming said material spray at a predetermined substantially oblique angle to said belt mask to apply a desired boundary to said material spray; transporting said spray and mask along predetermined paths relative to surfaces upon which material deposition of said sprayed material is to be applied with well defined boundaries; placing two-dimensional or three-dimensional machine vision sensors at multiple sites; maneuvering said moving mask by a robot using information from said vision sensors to maneuver the robot for establishing a desired mask line and to maintain an optimum distance between mask line and the mask.

* * * * *